US009240172B2

(12) United States Patent
Gadol, III

(10) Patent No.: US 9,240,172 B2
(45) Date of Patent: Jan. 19, 2016

(54) FOOT PEDAL

(71) Applicant: William N. Gadol, III, Summerville, SC (US)

(72) Inventor: William N. Gadol, III, Summerville, SC (US)

( * ) Notice: Subject to any disclaimer, the term of this patent is extended or adjusted under 35 U.S.C. 154(b) by 133 days.

(21) Appl. No.: 14/074,631

(22) Filed: Nov. 7, 2013

(65) Prior Publication Data

US 2014/0123839 A1 May 8, 2014

Related U.S. Application Data

(60) Provisional application No. 61/723,331, filed on Nov. 7, 2012.

(51) Int. Cl.
*G10H 1/32* (2006.01)
*G10H 1/34* (2006.01)

(52) U.S. Cl.
CPC ..... *G10H 1/348* (2013.01)

(58) Field of Classification Search
CPC .. G10H 1/46; G10H 2210/155; G06F 3/0334; G05G 1/30; G05G 1/305; G05G 2009/04748; G05G 1/44; G05G 1/487; G01L 5/225; G10D 13/021; G10G 7/02; H01C 10/10; G10C 3/26
See application file for complete search history.

(56) References Cited

U.S. PATENT DOCUMENTS

| | | | | | |
|---|---|---|---|---|---|
| 2,986,953 | A * | 6/1961 | De Armond et al. | 74/478 |
| D400,560 | S * | 11/1998 | Ridinger | D17/20 |
| 5,981,862 | A * | 11/1999 | Geier, Jr. | 84/746 |
| D504,458 | S * | 4/2005 | Edwards | D17/20 |
| D561,241 | S * | 2/2008 | Ridinger | D17/99 |
| 7,476,799 | B2 * | 1/2009 | Purchon et al. | 84/746 |
| 8,338,689 | B1 * | 12/2012 | Beaty | 84/746 |
| 2006/0156903 | A1 * | 7/2006 | Baird et al. | 84/453 |
| 2008/0173164 | A1 * | 7/2008 | Francis et al. | 84/721 |
| 2009/0199700 | A1 * | 8/2009 | Goldstein | 84/746 |
| 2013/0125736 | A1 * | 5/2013 | Osborne | 84/746 |
| 2013/0298752 | A1 * | 11/2013 | Juszkiewicz | 84/746 |
| 2014/0123838 | A1 * | 5/2014 | D'Amours | 84/626 |
| 2014/0205113 | A1 * | 7/2014 | Slipp et al. | 381/119 |

* cited by examiner

*Primary Examiner* — Marlon Fletcher
(74) *Attorney, Agent, or Firm* — Buche & Associates, P.C.; John K. Buche

(57) ABSTRACT

A musical instrument effects pedal system and related methods of use are provided. The system includes rotatable control mechanisms mounted on the side of the enclosure, easily manipulated by the foot of the user, for altering the audio signal output by an instrument.

8 Claims, 8 Drawing Sheets

FOOT PEDAL

CROSS-REFERENCE TO RELATED APPLICATIONS

This application claims the benefit and priority of U.S. Prov. App. Ser. No. 61/723,331 (filed Nov. 7, 2012) entitled "Foot pedal" and said document is hereby incorporated by reference in its entirety.

STATEMENT REGARDING FEDERALLY SPONSORED RESEARCH OR DEVELOPMENT

Not applicable.

BACKGROUND OF THE INVENTION

1. Field of Invention

The subject matter described in this specification relates to foot operated control systems for musical instruments. More specifically, said subject matter relates to foot pedals and related methods used to alter sound parameters of the audio signal output by a musical instrument.

2. Description of Related Art

Guitar effects pedals or "stompboxes" are foot operated effects units that are commonly used for enhancing and manipulating audio signals produced by electric guitars. Basic stompboxes comprise: a single footswitch; one to three rotary potentiometers for controlling the effect, gain or tone of the electric guitar; and, usually, an LED display to indicate whether the effect is on or off. See, e.g., U.S. Pat. No. D504,458 (issued Apr. 26, 2005) by Edwards and U.S. Pat. No. D561,241 (issued Feb. 5, 2008) by Ridinqer. More complex stompboxes can feature a plurality of footswitches or more than three potentiometers or other effects controls. See, e.g., U.S. Pub. App. Ser. No. 2008/0173164 (published Jul. 24, 2008) by Francis et al, U.S. Pat. No. 7,476,799 (issued Jan. 13, 2009) by Purchon et al, U.S. Pat. No. D400,560 (issued Nov. 3, 1998) by Ridinger. In operation, guitar effects pedals have been used to, among other things, produce distortion, cause delay, cause reverberation, and even cause volume adjustment of the sounds produced by electric guitars.

Known stompboxes are capable of producing a wide variety of effects depending on the position (i.e., configuration) of the potentiometers, wherein said effects are turned on or off ("bypass") via the footswitch. However, the effects of current stompboxes are not capable of being varied during a musical performance since potentiometer controls are not foot-operated and, for guitar players, hands are not available for turning the potentiometers. In other words, the potentiometers of known stompboxes are set in one position without control the entire time operators of the stompboxes play musical instruments. In view of the foregoing, a need exists for stompboxes configured for easy and precise manipulation of the potentiometers' position so that effects produced by the stompbox can be varied hands-free during a musical performance.

Some have developed various types of stompboxes in an attempt to meet said need. For example, U.S. Pub. Pat. App. No. 2009/0199700 (published Aug. 13, 2009) by Goldstein discloses a stompbox wherein one of three rotary potentiometers is raised relative to the other two potentiometers and outfitted with a large disk or portion thereof (see FIG. 7*c*). In operation, the disk is capable of being manipulated by an operator whereby the associated potentiometer's position changes. Although Goldstein's stompbox enables manipulation of one potentiometer, the disk is not an ideal solution to the above need because said disk: (1) is operated with rotating motions, which are not as natural as forward-backward movements; and (2) extends into the vicinity of the footswitch whereby operation of the stompbox is obstructed. Furthermore, operation of the other potentiometers is not hands-free. Finally, potentiometers are fragile and not designed to withstand the body weight or potential force of a foot whereby Goldstein's potentiometer may easily sheer, bend or strip during use. Accordingly, a need still exists for stompboxes configured for easy and precise manipulation of the potentiometers' position so that effects produced by the stompbox can be varied hands-free during a musical performance.

Others have developed stompboxes configured for hands-free manipulation of potentiometers. One such stompbox is disclosed in U.S. Pat. No. 5,981,862 (issued Nov. 9, 1999) by Geier, Jr. Geier, Jr. discloses a stompbox having a built-in potentiometer coupled to a disk that is rotatable about a horizontal axis. The disk is centrally located on the stompbox, just in-front of the footswitch, wherein the disk is suitable for rotation by a foot. Despite having one foot controlled potentiometer, Geier, Jr.'s stompbox is not ideal because the location of the disk can result in inadvertent depression of the footswitch since the operator must step over the footswitch to operate the disk with his or her foot. In other words, operation of the disk requires concentrated aiming of the foot, which can result in a decrease in the quality of the operators musical performance. Furthermore, since the disk is centrally located, the same is difficult to replace when worn-down. Finally, operation of the other potentiometers is not hands-free. Therefore, a need still exists for stompboxes configured for easy and precise manipulation of the potentiometers' position so that effects produced by the stompbox can be varied hands-free during a musical performance.

SUMMARY OF THE DISCLOSED EMBODIMENT

In view of the foregoing disadvantages inherent in heretofore known stompboxes or foot pedals, it is an objective of this application to disclose a foot pedal or stompbox that is configured for easy and precise manipulation of an associated potentiometers' position so that effects produced by the foot pedal or stompbox can be varied hands-free during a musical performance. In one embodiment the disclosed foot pedal or stompbox comprises: a housing; a footswitch in said housing; and least one potentiometer with a foot-operated control dial, said control dial located on either side of the housing. In operation, the user may manipulate the dial, hands-free, while playing a musical instrument.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which.

Figure 1:
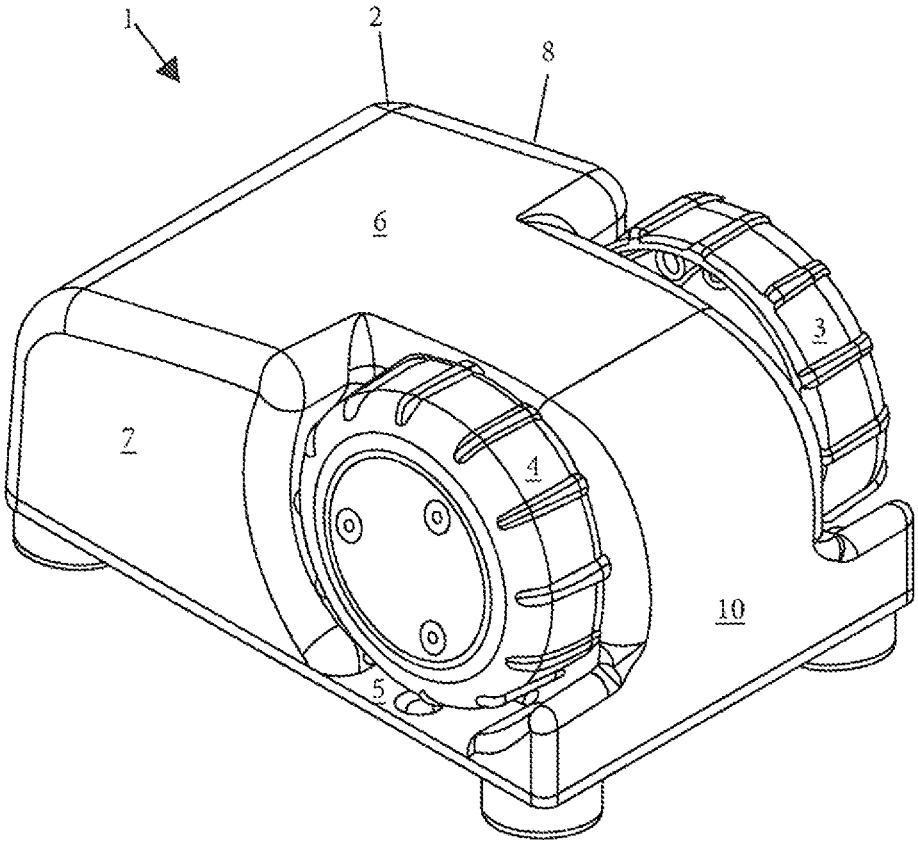
FIG. 1 depicts the rear perspective view of the foot pedal.

In the figures the referenced numerals are as follows:
pedal 1;
housing 2;
control dials 3 and 4;
base 5 with feet 5A;
top wall 6;
side-walls 7 and 8;
end-walls 9 and 10;
rigid member 11;
cylindrical members 12;
opening 13;
cylindrical member 14;
sleeve bearing 15;
Retaining ring 16;
wheel retainer 17; and,
variable resistance potentiometer 18.

It is to be noted, however, that the appended figures illustrate only a typical embodiment of the disclosed apparatus and are therefore not to be considered limiting of its scope, for the disclosed apparatus may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally disclosed is a foot pedal or stompbox that is configured for easy and precise manipulation of an associated potentiometers' position so that effects produced by the foot pedal or stompbox can be varied hands-free during a musical performance. In one embodiment the disclosed foot pedal or stompbox comprises: a housing; a footswitch in the housing; and least one potentiometer with a foot-operated control dial, the control dial located on either side of the housing. In operation, the user may manipulate the dial, hands-free, while playing a musical instrument. The more specific aspects of the disclosed foot pedal or stompbox are described with reference to the figures.

FIG. 1 depicts the rear perspective view of a foot pedal 1. Referring to FIG. 1, the pedal 1 generally comprises: a housing 2 with rotatable control dials 3, 4; and a base 5. The housing 2 is defined by a top wall 6, opposed side-walls 7, 8, and opposed end-walls 9, 10. As shown, the control dials 3, 4 are positioned in wells in the side walls 7, 8 toward at one end 10 of the housing 2. As discussed below, the control dials 3, 4 are configured to rotate in a well of the sidewalls 7,8. Suitably, the top of the control dials are vertically superior to the top wall 6 of the housing 2 so that they are accessible to the foot of a controller.

Figure 2:
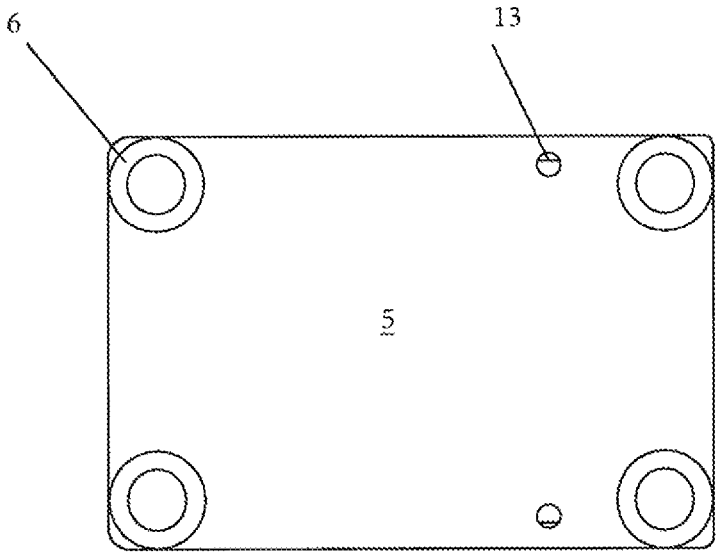
FIG. 2 depicts the bottom view of the foot pedal.

FIG. 2 depicts the bottom view of the foot pedal 1. Referring to FIG. 2, the base 5 is generally rectangular in shape and configured to removably attach to the housing 2. Suitably, the base features a plurality of feet 5A. The feet 5A may preferably be constructed of an elastomeric material such as rubber and be removably attached to each corned the bottom face of base 5 to help prevent the pedal 1 from moving or slipping during use. In another embodiment, the bottom face of base 5 is coated with a high friction coating to help prevent the pedal 1 from moving or slipping while used.

Figure 3:
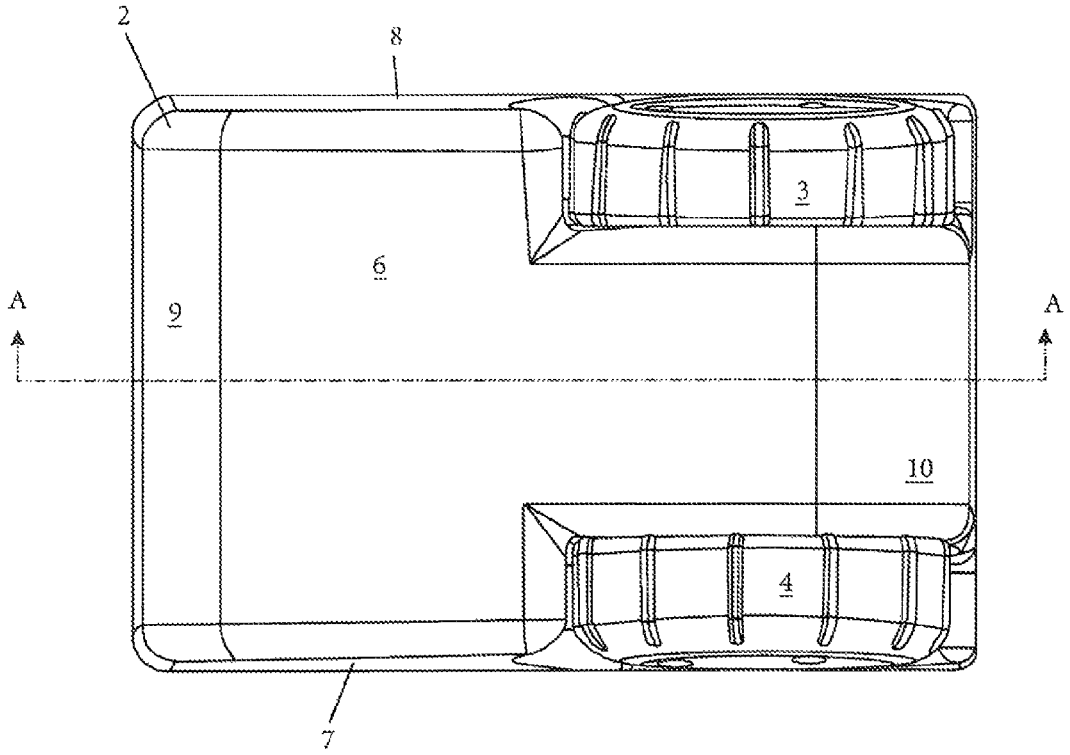
FIG. 3 depicts the top view of the foot pedal.

FIG. 3 depicts the top view of the foot pedal 1. Referring to FIG. 3, the portion of top wall 6 nearest to the end-wall 10 has a reduced width compared to the width of the portion of the top wall 6 nearest to end-wall 9. This configuration of top wall 6 creates recesses or wells on opposed sides of housing 2, wherein said wells are suitably adapted to receive control dial 3 as shown in FIG. 3 and FIG. 4.

Figure 4:
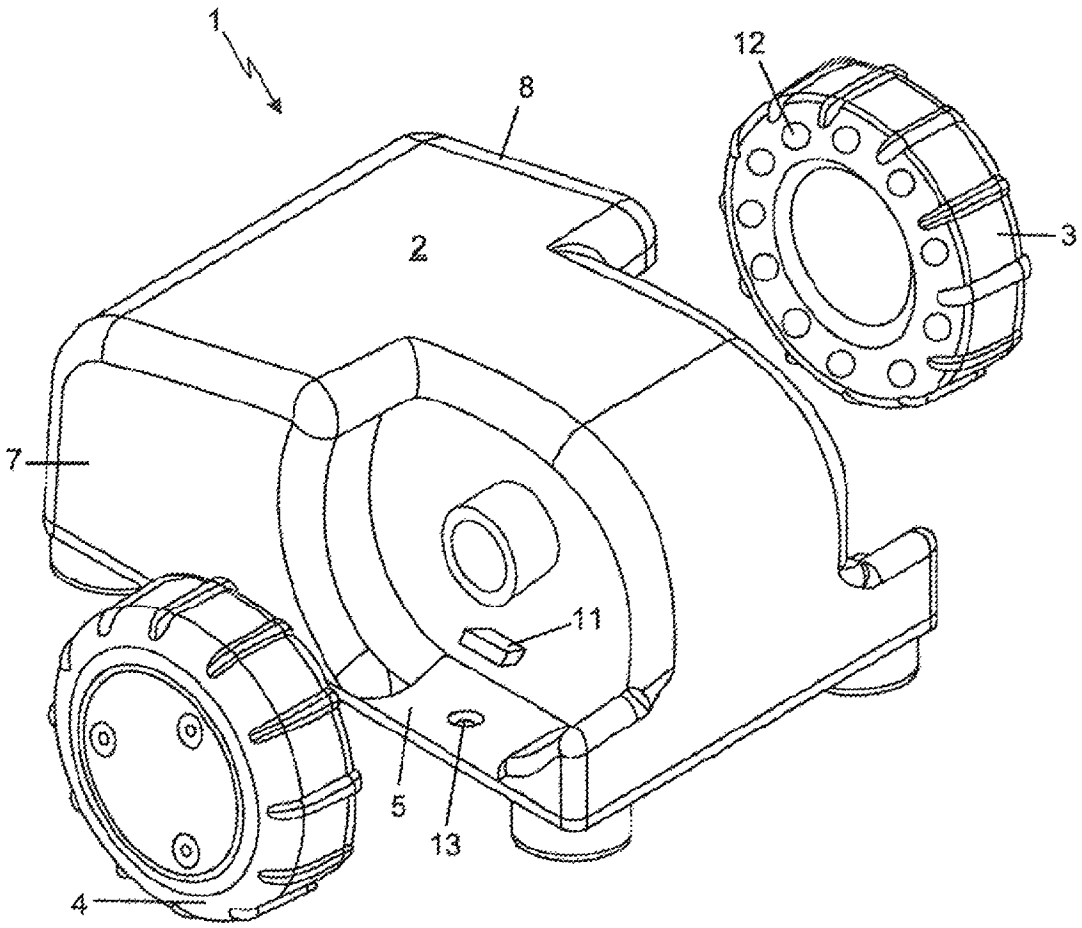
FIG. 4 depicts the rear perspective view of the foot pedal with control dials detached.

FIG. 4 depicts an exploded perspective view of the foot pedal 1 with control dials 3, 4 removed from the wells in the sidewalls 7, 8. As substantially shown in FIG. 4, a rigid member 11 extends horizontally from the well of side-wall 7. Although not pictured, a rigid member similar to rigid member 11 correspondingly extends horizontally from the well of side-wall 8. As shown, the control dials 3, 4 feature cylindrical members 11 around their periphery (particularly shown on control dial 3 in FIG. 4). When a suitably adapted peg is received by any of the cylindrical members 12, the peg interacts with the rigid member 11 extending horizontally from the well of the side-walls 7, 8 to so that the rigid member 11 functions as a manual stop. In operation, strategic placement of pegs in any of the cylinders may suitably restrict the range that the control dials 3, 4 are able to rotate. Although not pictured, cylindrical members similar to cylindrical members 12 are located on the periphery on control dial 4. In the wells, underneath the control dials 3, 4, are openings 13 in the base 5. In one method of use, the pedal 1 may be affixed to a pedal board (not shown) by a nail or by rotating a suitably adapted screw into the top face of base 5 through opening 13 and into a pedal board.

Figure 5:
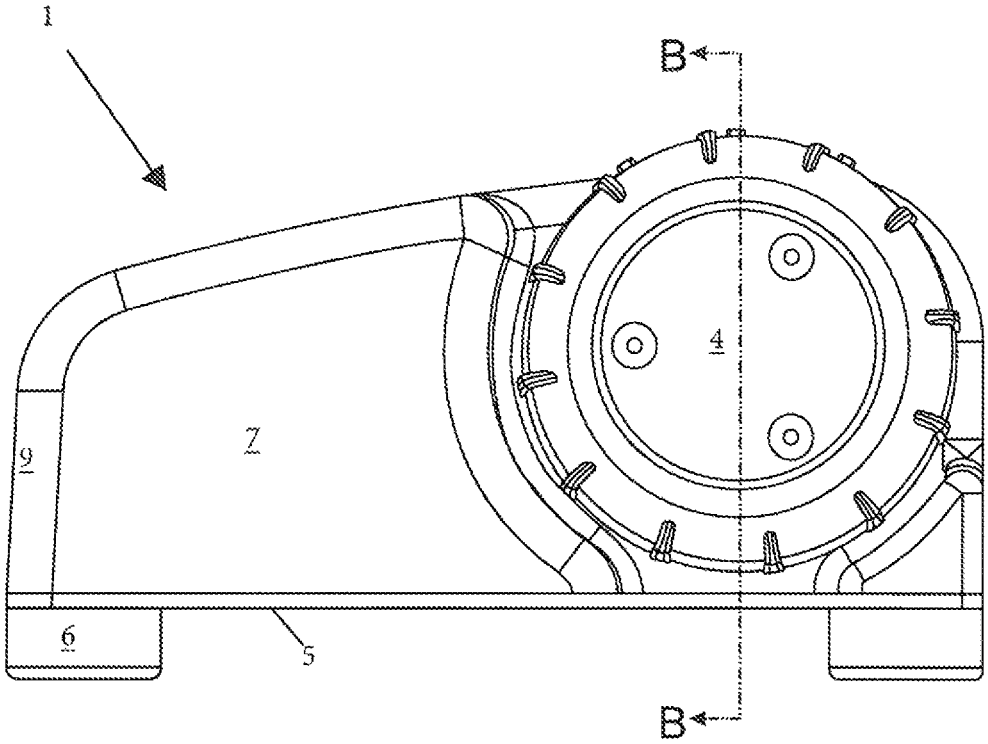
FIG. 5 depicts the side view of the foot pedal.

FIG. 5 depicts the side view of the foot pedal 1. Referring to FIG. 5, the vertical height of the end-wall 9 relative to the base 5 is less than height of the end-wall 10 relative to the same reference. As a result of this configuration, the top wall 6 appears to taper downwardly from one end-wall 10 to the other 9.

Figure 6:
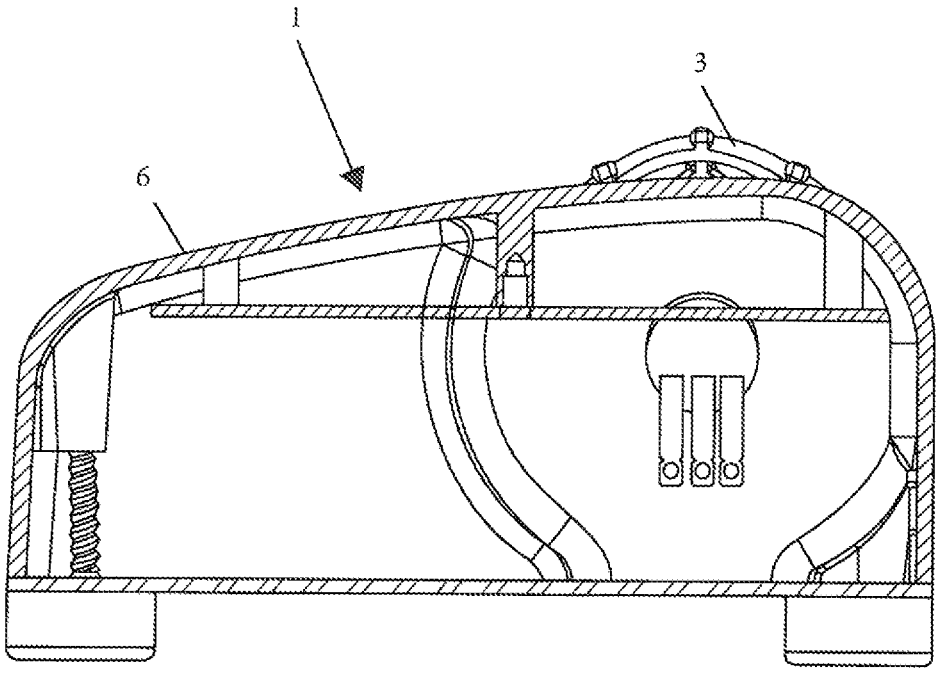
FIG. 6 depicts a cross-sectional view of the foot pedal along the longitudinal axis.

FIG. 6 depicts a cross-sectional view (along line A-A of FIG. 3) of the foot pedal along the longitudinal axis. As shown in FIG. 6, a portion of the control dial 3 extends above the plane defined by the top wall 6. The ergonomic configuration of the pedal 1 allows the foot of a user to comfortably rest on the top surface of top wall 6 at one end 9 of the pedal 1 before engaging the control dials 3, 4 when necessary.

Figure 7:
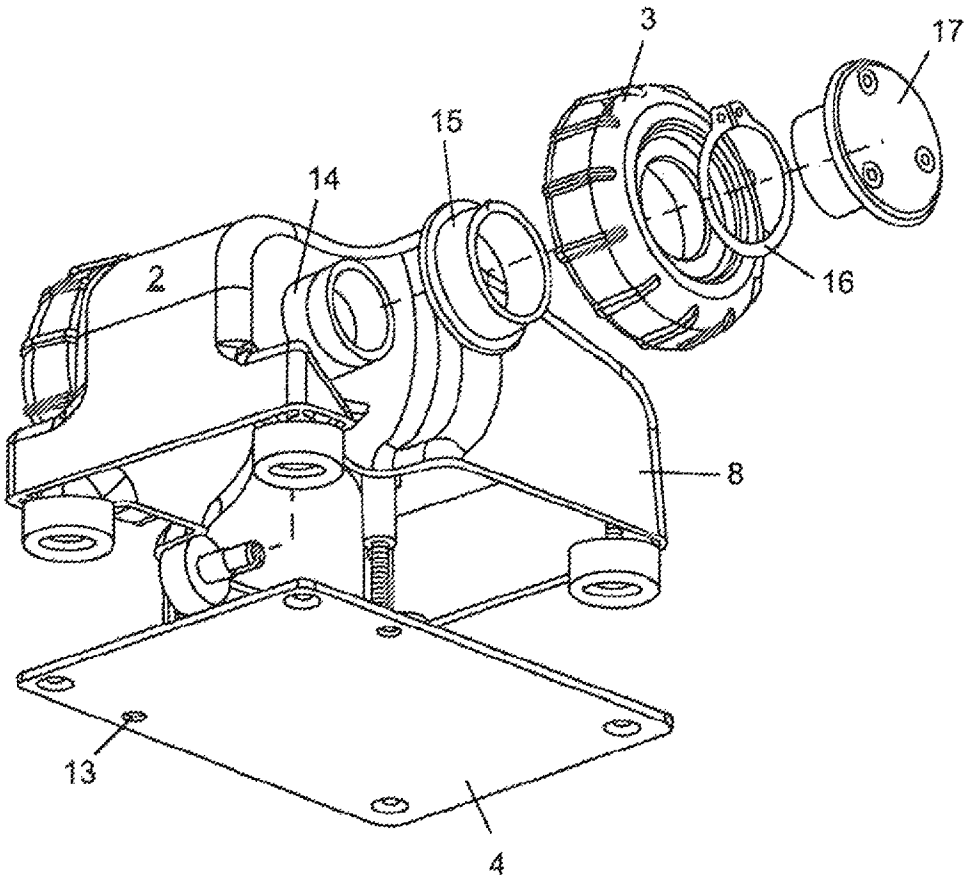
FIG. 7 depicts an exploded view of the foot pedal.

FIG. 7 depicts an exploded view of the foot pedal 1. Specifically, FIG. 7 depicts the assembly of one of the dials 3 to the housing 2. Also shown is the rotatably attachment of the control dial 3 to the side-wall 8. Suitably, coaxially aligned rigid cylindrical members 14 are Integrally attached to the housing 2 whereby the same extend horizontally from side-walls 7 and 8. Preferably, a sleeve bearing 15, which is generally cylindrical in shape, rotatably mounts on the cylindrical member 14. After instillation of the bearing 15, a portion of the sleeve bearing 15 that is proximal to the end-wall 8 may be integrally affixed with a flange so that the control dial 3 easily to mounts onto the sleeve bearing 15. In a preferred embodiment, a retaining ring 16 may couple onto a groove or notch provided on the end of the cylindrical member 14 to prevent the control dial 3 and sleeve bearing 15 from unmounting from cylindrical member 14. In the depicted embodiment, the peripheral face of the control dial 3 has ridges or undulations to facilitate manipulation by the foot of the user. In another embodiment, the peripheral face of control dial 3 may be numbered to correspond to the operating parameters of pedal 1.

Referring again to FIG. 7, a wheel retainer 17 that is generally cylindrical in shape and that has an outer radius less than outer radius of sleeve bearing 15, is received by and couples to the sleeve bearing 15. The portion of the wheel retainer 17 that is distal to the side-wall 8 is integrally affixed with a disk wherein the diameter of the wheel retainer 17 may preferably exceed the outer diameter of the sleeve bearing 15. Preferably, said disk of the wheel retainer 17 may be removably attached to the control dial 3 by screws or tabs. In one mode of construction, screws removably attach the base 5 to the bottom of the housing 2.

Figure 8:
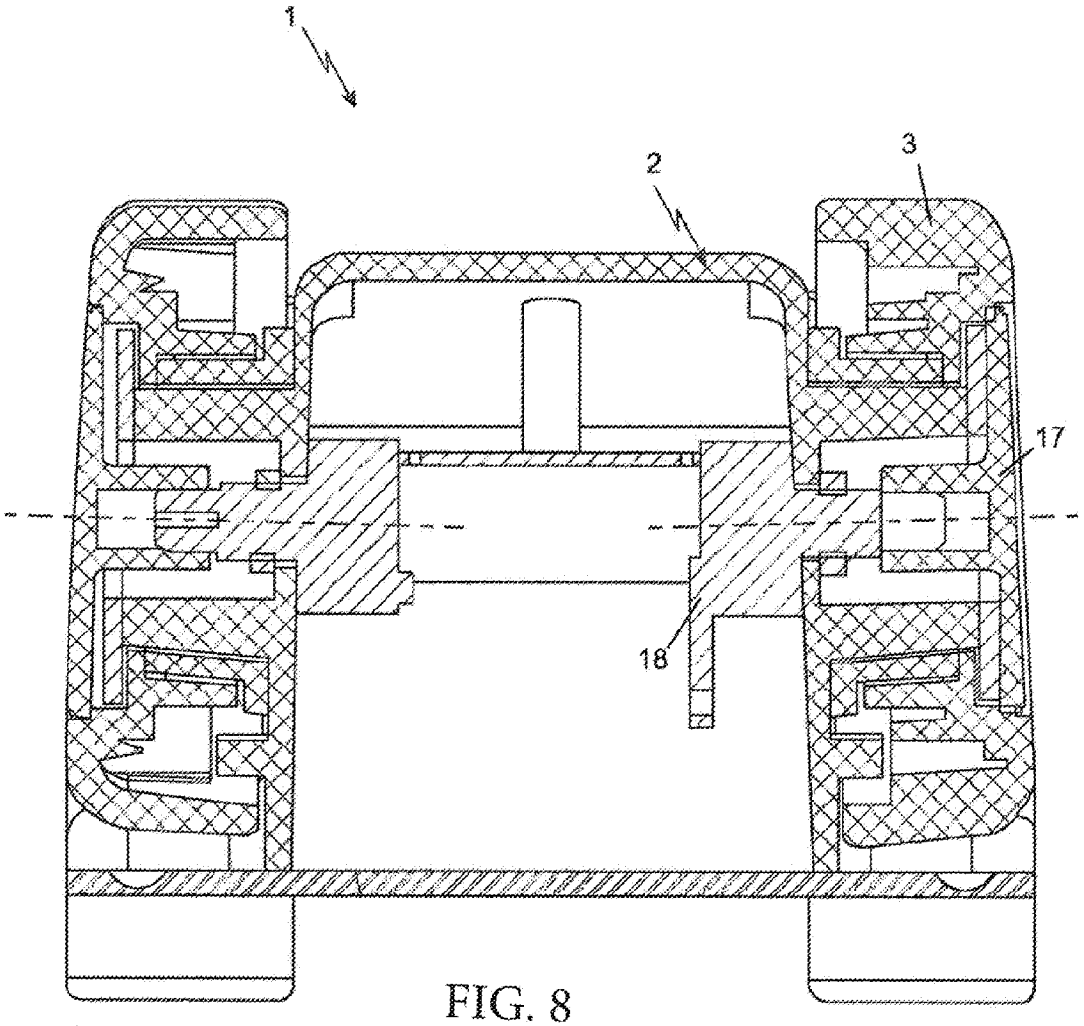
FIG. 8 depicts a cross-sectional view of the foot pedal along the horizontal-axis.

FIG. 8 depicts a cross-sectional view (line B-B from FIG. 5) of the foot pedal along the horizontal-axis. Referring to FIG. 8, variable resistance potentiometer 18 is within the housing 2 of pedal 1. The potentiometer preferably features a control shaft, the outer radius of which is less than the internal radius of wheel retainer 17, is suitably shown as received by and coupled to the wheel retainer 17. Since wheel retainer 17 is coupled with control dial 3, rotating control dial 3 causes wheel retainer 17 to rotate and, in view of the above described mechanical connections, correspondingly causes the shaft of potentiometer 18 to rotate. Suitably, rotating the potentiometer 18 suitably alters the operating parameters of pedal 1. Effectively, the control dial 3, 4 attachment assembly enables potentiometer 18 to be controlled by rotating control dial 3.

Referring to FIG. 1 through 8, a foot operated musical instrument effects pedal is depicted, although the present invention contemplates any foot operated control system having rotatable dials. Although the foregoing description of the present invention covers a specific embodiment, it will nevertheless be understood and appreciated by those familiar with the art that changes, modifications and substitution of equivalent functioning elements may be made in the described embodiment without departing from the spirit and scope of this invention. For example, although electrical components are shown and described herein as being actuated by the control dials, any number of other types of control components can be similarly controlled or adjusted, including pneumatic, electrostatic, magnetic, hydraulic, mechanical and like control components. Still further, the two control dials can be made to actuate control components in two different systems, as well as systems of different types independent of each other but yet cooperatively associated by way of the foot operated control system. In view of the foregoing, it is contemplated by the appended claims to cover all such variations and modifications which fall within the true spirit and scope of this invention.

I claim:

1. A foot pedal comprising:
a housing;
a footswitch in said housing;
at least one potentiometer with a foot-operated control dial, said control dial located on either side of the housing;
wherein the control dial is positioned in a well of one of the side walls, toward one end of the housing;
wherein the control dial is configured to rotate in the well; and,
wherein the control dial features at least one cylindrical receptacle configured for receiving a peg, wherein the peg interacts with a stopper in the side wall to restrict rotation of the control dial.

2. A method of using an effects pedal comprising:
obtaining an effects pedal comprising
a housing,
a switch in said housing, and
at least one potentiometer with a foot-operated control dial, said control dial located on either side of the housing;
manipulating the foot-operated control;
wherein the control dial is positioned in a well of one of the side walls, toward one end of the housing;
wherein control dial is configured to rotate in the well; and,
wherein the control dials has a portion that is vertically superior to the top wall of the housing whereby the same is accessible to the foot of a controller; and,
wherein the control dial features at least one cylindrical receptacle configured for receiving a peg, wherein the peg interacts with a stopper in the side wall to restrict rotation of the control dial.

3. A method of using a foot pedal comprising the step of
obtaining an effects pedal comprising
a housing,
a switch in said housing, and
at least one potentiometer with a foot-operated control dial, said control dial located on either side of the housing;
removing said control dial;
inserting a peg into a cylindrical receptacle in said control dial;
reattaching said control dial; and,
manipulating the control dial until said peg interacts with a stopper member on said housing.

4. The method of claim 3 wherein the housing comprises:
a top wall;
opposed side-wall with wells; and,
opposed end-walls.

5. The method of claim 3 wherein the control dial is positioned in a well of one of the side walls, toward one end of the housing.

6. The method of claim 5 wherein control dial is configured to rotate in the well.

7. The method of claim 6 wherein the control dials has a portion that is vertically superior to the top wall of the housing whereby the same is accessible to the foot of a controller.

8. The method of claim 6 wherein the control dial features at least one cylindrical receptacle configured for receiving a peg, wherein the peg interacts with a stopper in the side wall to restrict rotation of the control dial.

* * * * *